US010682001B2

(12) United States Patent
Herzig

(10) Patent No.: US 10,682,001 B2
(45) Date of Patent: Jun. 16, 2020

(54) PUTTING-ON AID FOR A SUPPORT STOCKING

(71) Applicant: Georg Herzig, Zürich (CH)

(72) Inventor: Georg Herzig, Zürich (CH)

( * ) Notice: Subject to any disclaimer, the term of this patent is extended or adjusted under 35 U.S.C. 154(b) by 44 days.

(21) Appl. No.: 15/754,674

(22) PCT Filed: Aug. 26, 2016

(86) PCT No.: PCT/CH2016/000111
§ 371 (c)(1),
(2) Date: Feb. 23, 2018

(87) PCT Pub. No.: WO2017/031604
PCT Pub. Date: Mar. 2, 2017

(65) Prior Publication Data

US 2018/0242767 A1 Aug. 30, 2018

(30) Foreign Application Priority Data

Aug. 27, 2015 (CH) ..... 1236/15

(51) Int. Cl.
*A47G 25/90* (2006.01)

(52) U.S. Cl.
CPC ..... *A47G 25/905* (2013.01)

(58) Field of Classification Search
CPC ..... A47G 25/905; A47G 25/908; A47G 25/90
USPC ..... D2/641
See application file for complete search history.

(56) References Cited

U.S. PATENT DOCUMENTS

| | | | | |
|---|---|---|---|---|
| 5,069,374 A * | 12/1991 | Williamson | ..... | A47G 25/908 223/111 |
| 5,636,774 A | 6/1997 | Moscato | | |
| 6,536,636 B1 | 3/2003 | McDonniel | | |
| 8,356,735 B1 | 1/2013 | Drakeford | | |
| 2007/0095866 A1* | 5/2007 | Zumbach | ..... | A47G 25/905 223/111 |

FOREIGN PATENT DOCUMENTS

| | | |
|---|---|---|
| DE | 8906458 | 7/1989 |
| DE | 693 20 493 | 4/1999 |
| DE | 10 2004 032 555 | 2/2006 |
| GB | 850165 | 9/1960 |
| NL | 9000361 A * | 9/1991 |
| WO | 2012/032459 | 3/2012 |

OTHER PUBLICATIONS

English translation of International Search Report on Patentability dated Feb. 27, 2018 (Feb. 27, 2018), Application No. PCT/CH2016/000111, 8 pages.

* cited by examiner

*Primary Examiner* — Ismael Izaguirre
(74) *Attorney, Agent, or Firm* — Rankin, Hill & Clark LLP

(57) ABSTRACT

A putting-on aid for support stockings, including a carrier element that is capable of at least partly encompassing a body part. The putting-on aid includes at least one motor which is designed to bring the carrier element or parts thereof into motion, wherein the motion is capable of at least assisting a rolling-off and rolling-up of a support stocking.

19 Claims, 6 Drawing Sheets

PUTTING-ON AID FOR A SUPPORT STOCKING

BACKGROUND OF THE INVENTION

Field of the Invention

The invention relates to the field of orthopaedic aids, in particular to orthopaedic stockings and in particular to devices which simplify the handling of these.

Description of Related Art

Orthopaedic stockings, also called support stockings or compression stockings are used for example following a thrombosis, for treating varicose veins and ulcerated legs as well as in a supporting manner in sport and with activities which entail standing for a long time.

The putting-on and taking-off of a support stocking can be an awkward and strenuous matter, depending on the compression class of the applied support stocking, and such can entail much effort on the part of people who are limited in their mobility, as well as older or handicapped persons. Very often, people are reliant on external help, wherein such help can also turn out to be difficult and strenuous.

There are various ideas and devices, with which one attempts to simplify the putting-on and taking-off of support stockings. Rubber gloves which have an increased friction coefficient due to their surface nature, by which means the gripping and pulling of the support stocking is simplified are very widespread. However, the force effort which itself is necessary for putting on or taking off the support stocking still needs be applied to the same extent by hand, even with the application of such rubber gloves.

Support stocking pre-stretching devices, via which a part of the support stocking can be stretched open, so that the body part can be pushed into this more simply, are more suitable inasmuch as this is concerned. As a rule, such devices are bulky and cannot be used for taking off the support stocking. Moreover, a significant amount of time is necessary, in order to wind the support stocking onto the pre-stretching device.

Another type of putting-on aids uses expanding/widening means which can be moved along the body part. Amongst other things, rings, onto which the stockings are rolled up in a first step and are again unrolled on the body part in a second step, belong to such expansion aids. The documents GB 850165-A, DE 8906458 U1 and DE 102004032555 A1 describe putting-on aids of this type, wherein apart from the underlying concept, first and foremost the rolling behaviour of the ring and the problem of this having too rigid a structure are dealt with. Apart from an elastically deformable ring for putting on and taking off a stocking, U.S. Pat. No. 6,536,636 moreover shows a winding-up device, with which the stocking can be wound onto the deformable ring before putting it on.

A considerable force effort must still be applied by the user even in the case of annular putting-on aids. Moreover, the body posture which the user who is often restricted in his/her movements must assume on putting-on and taking-off, but also on applying the force, is not comfortable. Finally, the rolling up of the support stocking onto a ring is a time-consuming and laborious matter even when using further means or tools, if the rolling-up is not done directly when taking off the support stocking. However, this is not always possible for hygienic reasons.

SUMMARY OF THE INVENTION

A possible object of the invention is to deal with the disadvantages of the mentioned putting-on and taking-off aids for support stockings, in particular concerning the force effort, as well as to increase the user-friendliness.

It is further a possible object of the invention to provide a device that permits a simple rolling-off as well as rolling-up of a support stocking from and onto an element which carries the support stocking and possibly stretches it out.

Although the claimed invention relates to a device which serves for putting on as well as taking off support stockings, the device is hereinafter called a putting-on aid. It is to be understood that this expression has no limiting significance and in particular does not exclude the taking-off of a support stocking as well as possible preparatory steps, such as the rolling of the support stocking onto a putting-on aid or parts thereof or the positioning of the putting-on aid or parts thereof.

One embodiment of the putting-on aid includes a carrier element, whose surface comes into contact with the support stocking, and at least one motor. The at least one motor brings the carrier element or parts thereof, for example the surface of the carrier element or parts of this surface, into motion, wherein this motion is capable of at least assisting in a rolling-off and rolling-up of the support stocking after the support stocking and the carrier element have been brought into contact in a certain relative position to one another.

In particular, the putting-on aid can include precisely one motor which is designed to set the carrier element and/or its surface into motion. However, it is also possible for the putting-on aid to include two, three four or more motors, wherein the different motors can be of the same type or can differ in their manner of functioning, arrangement and/or characteristic characteristics/properties (for example produced torque, size etc.).

The at least one motor can be part of the carrier element, for example by way of this being located in an inner space which is defined by the surface of the carrier element.

The motor can be a drive motor, which is yet to be described in more detail hereinafter.

However, the at least one motor can also be located in a component of the putting-on aid, which is different from the carrier element.

For example, it is conceivable for the putting-on aid to include a guide rail. The motor can be integrated into the guide rail and can bring the carrier element into motion for example amid the application of a guide jaw. In particular, the movement which is thus produced can include a movement along the body part, onto which the support stocking is to be brought or from which the support stocking is to be removed. The motor, guide rail and/or guide jaws can be configured such that the motor induces a self-rotation of the carrier element or that the motor, guide rail and/or guide jaw at least do not prevent such a self-rotation.

The motor can be a guide motor, which is yet described in more detail hereinafter.

Concerning a support stocking which includes an opening for inserting a body part, this position can be given, for example, by way of the part of the support stocking that defines the opening being hooked with the carrier element, so that this part of the support stocking and the carrier element are fixedly, but releasably connected.

The surface of the carrier element can be of such a nature that the coefficient of friction of the support stocking on this surface is so high that a slipping of the support stocking on this is prevented. For example, the surface can include naps, hooks or clips. Alternatively or supplementarily, it can be manufactured of a material that has a high friction coefficient.

The carrier element is further designed such it is capable of at least partly encompassing a body part, for example a leg, an arm or parts of the leg or arm. In embodiments, in which the carrier element is capable of completely encompassing the body part, the carrier element can additionally have a mechanism, by way of which the carrier element can be brought from a condition, in which it encompasses the body part, into a condition, in which it does not completely encompass the body part. Such a mechanism includes a closing and opening mechanism, for example on the basis of a sliding connection or plug-in connection or a bayonet connection. Such a mechanism also includes means, in order to enlarge the opening that has arisen after the opening of the carrier element, for example by way of the carrier element being able to be deformed in the opened condition or by way of parts thereof being able to be angled via a joint.

The carrier element can also be designed such that one can make do without a closing/opening mechanism. In particular, the carrier element can be positioned on the body part or removed from this, by way of the carrier element in a condition, in which it at least partly encompasses the body part as on operation, being moved along the body part.

Independently of whether the carrier element is capable of completely encompassing the body part or not, the carrier element can be designed in a manner such that it is deformable to such an extent that it renders possible a simple application of the carrier element on the body part or a simple removal. This deformability can be achieved, for example, by way of the carrier element including elastic elements or by way of it including mechanical elements, via which the dimensions of the carrier element can be changed.

These elastic elements co-encompass an element that is designed to produce an internal tension in the carrier element. This internal tension leads to a contraction of the carrier element that, in particular, effects a reduction of that area in which the body part is located on operation and that is defined by the shape of the carrier element. On operation, the body part counteracts this contraction, by which means the carrier element exerts a pressure upon the body part, the pressure being dependent on the elastic element. Springs and elastic bands are examples of such elastic elements.

In particular, carrier elements that are capable of completely encompassing a body part can include such an elastic element.

The force that is produced by the at least one motor and that is transmitted via the movement of the carrier element and/or via the surface of the carrier element is preferably sufficient to ensure the rolling-off and rolling-up of the support stocking without assistance by the user.

The force transmission between the at least one motor and the carrier element or between the at least one motor and the surface of the carrier element takes place in particular via at least one transmission. Each unit consisting of a motor and at least one transmission herein produces a torque of at least 5 Nm, for example at least 10 Nm, preferably at least 50 Nm or at least 100 Nm. The total torque that is produced by the carrier element can be further increased by way of the use of several motor/transmission units, which is to say that the demand on each motor/transmission unit can be reduced with respect to the produced torque.

The total torque that is produced by the carrier element is at least 10 Nm, in particular at least 50 Nm or at least 100 Nm or at least 200 Nm.

In particular, the force that is produced by the at least one motor, optionally geared by at least one transmission and transmitted via the movement of the carrier element and/or via the surface of the carrier element is sufficient to ensure the rolling-off and rolling-up of support stockings of up to and including compression class 4, at least however up to and including compression class 3 or at least up to and including compression class 2, without assistance by the user. There is also the possibility of preventing or slowing down a rolling-off, which is caused by tensions arising in the support stocking, by way of the motor, due to the fact that the carrier element can execute the two movements, which are opposed to one another and which are necessary for rolling-off and rolling-up.

The putting-on aid is preferably used for accomplishing or simplifying or assisting the rolling-off and rolling-up of the support stocking directly on a body part, which is to say that the putting-on aid can be used directly for putting on and taking off the support stocking. In this case, the carrier element at least partly encompasses the body part and the carrier element advances along the body part. This advancing along the body part is coordinated with the movement for the rolling-off and rolling-up in such a manner that the support stocking ideally comes to lie on the body part along the advance direction of the carrier element without the occurrence of creases and without an excessive loading of the support stocking.

Since the rolled-off or rolled-away support stocking snuggles tightly on the body part and also does not slip under loading, the rolling-off/rolling-up and the advancing of the carrier element along the body part can be effected by the same movement of the carrier element or parts thereof and thus by the same at least one motor.

However, it is also possible for the putting-on aid to include motors which carry out different functions. For example, one or more motors of a first type can effect a self-rotation of the carrier element, whereas one or more motors of a second type can assist or effect a displacement of the carrier element along the body part. Furthermore, there can be motors of a third type which increase the user friendliness or the comfort of the putting-on device. The latter can also include the automatic adaptation of the dimensions of the putting-on aid and of parts of this.

In an embodiment, the carrier element has the shape of a torus. The carrier element can differ somewhat from this shape, since the components of the carrier element such as for example the subsequently described drive unit or the subsequently described adjusting mechanism can have a straight shape.

In particular, the carrier element can have the shape of a rotation torus. The shape of a rotation torus arises for example by way of a circle being rotated about a rotation axis, wherein the rotation axis is preferably perpendicular to the normal of the surface defined by the circle. A rotation torus that is defined is such a manner includes a circle line that is given by the path of the middle point of the rotating circle. The circle line therefore runs centrally within the volume of the rotation torus.

A rotation torus that is defined in such a manner moreover has a large radius that corresponds to the radius of the circle that is defined by the circle line, and a small radius, which corresponds to the radius of the rotating circle. The large radius must be greater than the small radius so that a rotation torus in the context of the invention arises.

In an embodiment, the carrier element further includes at least one drive unit and at least one advance unit. Each of the at least one advance units executes a revolving movement, for example about a longitudinal axis of the drive unit, about the mentioned circle line of the rotation torus or about another axis of the putting-on aid or a volume of a part of the putting-on aid, said volume being constant. Herein, the at least one advance unit is arranged such that it forms the surface of the carrier element or parts of the surface of the carrier element.

The advance unit can be manufactured in a deformable manner, for example by way of it consisting of elastic materials or by way of using elements that movably engage into one another, in order to permit an revolving movement of the at least one advance unit also around arcuate axes or volumes with an non-circular cross section.

The revolving movement is powered by at least one drive unit. Herein, in an embodiment, a drive unit can drive all advance units. However, it is also possible for each of the at least one advance unit to be driven exclusively by one or more drive units.

The revolving movement of the at least one advance unit, the advance unit simultaneously forming the surface of the carrier element or parts thereof, can be part of the initially described movement of the carrier element or of parts thereof, the movement leading to the support stocking being rolled away or rolled up.

In an embodiment of the putting-on aid, this includes at least one drive motor and a drive shaft, which is driven by the drive motor. It is this drive motor that drives the at least one drive unit. In an embodiment, each of the at least one drive units includes a drive motor with an associated drive shaft. Alternatively, one drive motor can drive all drive units.

Moreover, the drive motor is spatially delimited by a motor housing.

The drive unit can include further components, in embodiments, in which each of the at least one drive units includes a drive motor and a drive shaft that is driven by the drive motor. These further components can be divided into two categories: components of a first category are coupled to the drive shaft in a direct manner or indirectly, for example via a transmission or gearwheels and execute a rotation movement. Components of a second category do not change their position relative to the motor housing.

In an embodiment, the drive unit includes at least one component of a first category and at least one component of a second category.

In an embodiment, the drive unit includes the following components of the first category: a planetary gear, which is driven by the drive motor via the drive shaft, and an advance connecting piece.

The advance connecting piece can include a ring gear of the planetary gear or be the ring gear of the planetary gear. The advance connecting piece, for example the ring gear can at least partly have an inner-side toothing.

The advance connecting piece represents an interface between the drive unit and the advance unit. It is designed such that the rotation movement, which is delivered by the drive motor to the drive shaft and is geared via the planetary gear, is transmitted onto the advance unit, by which means the advance unit or parts thereof carry out the revolving movement.

Supplementarily, this embodiment of the putting-on aid includes the following components of the second category: a fixation block and a bearing. The fixation block connects all components that assume a fixed position relative to the motor housing, i.e., it connects all components of the second category. These, for example, are also connecting and fixation elements, parts of the control or of the energy supply. The bearing ensures that the fixation block, or the components of the second category do not inhibit the rotation movement of the components of the first category.

In particular, the bearing permits a movement of the components of the first category relative to the fixation block.

The planetary gear can be realised with a stationary gear ratio. For this, the planetary gear can include one or more planet wheels that each include a rotation pivot that does not move relative to the fixation block, for example by way of this rotation pivot being mounted on the fixation block in a rotationally fixed manner.

In an embodiment, the putting-on aid includes at least two drive units. These are connected by one or more connecting elements that are anchored in the fixation block. The connecting elements are preferably torsionally stable, i.e. are stable with respect to a twisting along the axis which connects the drive units.

The connecting elements can run in the inside of the carrier element, which means that they are not visible when the carrier element is viewed externally. However, they can also be parts of a housing, wherein this, by way of a suitable mounting and/or recesses, is designed such that the moving parts of the surface of the carrier element are not compromised in their movement.

In an embodiment, the putting-on aid includes an adjusting mechanism that is capable of changing the length of an axis which delimits the cross-sectional area that can be at least partly surrounded by the carrier element on operation. "On operation" means that the carrier element encompasses the body part in the manner that is envisaged for the rolling-off and rolling-up. As a rule therefore, it is a longitudinal axis of the carrier element.

In the case of a carrier element in the form of a rotation torus, this axis is the circle line which, as described beforehand, is given by the path of the middle point of the rotating circle, thus the circle line that runs centrally within the volume of the rotation torus. A change of the length of the circle line changes the large radius of the rotation torus and therefore the diameter of the opening that is defined by the rotation torus.

The adjusting mechanism has a spatial extension that is smaller than the length of the mentioned axis. This spatial extension of the adjusting mechanism is preferably smaller than a third of the total length of the mentioned axis.

The adjusting mechanism is arranged such that the mentioned spatial extension runs along the mentioned axis of the carrier element itself or along an axis that runs parallel to this or along the tangents to the mentioned axis at the position of the adjusting mechanism or along the tangents of the axis that runs parallel to this.

The at least one adjusting mechanism can be located within the volume that is defined by the surface of the carrier element.

Supplementarily, the adjusting mechanism can include an arresting device, with which the mentioned spatial extension, which prevails before the arresting, can be fixed. This can be advantageous when applying the carrier element around the body part or on taking this off, or on introducing the carrier element into a guide jaw.

In an embodiment, the adjusting mechanism includes at least two part-elements that overlap in a region along the mentioned spatial extension of the adjusting mechanism. The adjusting mechanism moreover includes an adjusting motor and an adjusting gear, which is driven by the adjusting motor. The length of the overlapping region of the part elements is enlarged or reduced with the help of the adjusting gear and adjusting motor, by which means the mentioned spatial extension of the adjusting mechanism changes.

The adjusting motor, which is used for enlarging or decreasing the overlapping region, can be identical to the drive motor. In this case, one can switch between a drive of the adjusting mechanism and a drive of the drive unit by way of an automatic control, which includes for example a sensor, and/or a manual control. Alternatively, one can realise a simultaneous operation of the adjusting mechanism and the drive unit, the operation being controlled, for example, via a control loop or being of an alternating nature.

Embodiments of the putting-on aid which include an adjusting mechanism can include push guides and/or screw/worm gears.

Supplementarily, the adjusting mechanism can include a sensor that measures the tensile force that occurs along the mentioned axis of the carrier element and wherein the adjusting mechanism changes its mentioned spatial extension on the basis of this measurement. If, for example a first limit value for the tensile force is exceeded, then the mentioned spatial extension is increased until a second limit value is reached. The reverse procedure is also possible. If a third limit value for the tensile force, which can be identical to the second limit value, is fallen short of, then the mentioned spatial extension is reduced until a fourth limit value is reached, wherein this fourth limit value can be identical to the first limit value.

Supplementarily or alternatively, the adjusting mechanism can include a control of the adjusting motor, via which control the mentioned spatial extension of the adjusting mechanism can be manually changed.

In an embodiment, the putting-on aid can moreover include a guide jaw and at least one guide rail. The at least one guide rail runs almost parallel to the axis of the body party, along which the support stocking is put or taken off, on operation of the putting-on aid. The axis of the guide rail, which runs almost parallel to the mentioned axis of the body, is hereinafter called longitudinal axis (of the guide rail).

The guide jaw is connected to the guide rail. This connection can be rigid, but it can also permit a movement of the guide jaw along the longitudinal axis of the guide rail. The latter leads to the ideal starting position of the carrier element for putting or taking off the support stocking being able to be adjusted by the user and to the position of the guide rail relative to the user not changing, which increase the user friendliness, particularly if control or regulating elements are attached to the guide rail.

The guide jaw is designed such that this holds the carrier element in a defined position relative to the guide jaw, wherein however the movement of the carrier element, which is effected by the rolling-off and rolling-up, is not inhibited. This can be accomplished for example by way of the guide jaw including rollers, wherein the carrier element, which is surrounded by the support stocking, is essentially in direct contact only with these rollers and is supported and held in position by these. Supplementarily, these rollers can assist in a crease-free winding-off and winding-up of the support stocking by way of the rollers having a suitable surface nature and/or being driven themselves by a motor.

The guide jaw is not rigid, but is elastic, in order not to counteract the change of the dimensions of the carrier element, which can be effected via the adjusting mechanism or not to completely prevent these changes.

In particular, it is possible for the guide jaw not to be closed per se, but can include an opening, for example on the side tht is opposite to the guide rail. By way of this, the guide jaw can easily follow a change of the length of the mentioned axis of the carrier element, which delimits the area that is at least partly surrounded by the carrier element on operation.

Supplementarily, the guide jaws can include means that are designed to simplify the application and removal of this. For example, the guide jaw can include a bow, a buckle or hinge.

Complementarily, the guide jaw can be designed such that this is cable of holding the carrier element with as well as without a rolled-up support stocking, in a way and manner such that a force can be transmitted from the guide rod onto the carrier element via the guide jaw. This force can, for example, serve for changing the orientation and positioning of the carrier element relative to the body part or for reducing the pressure that is exerted by the carrier element onto a location of the body part.

The guide rail can include a hand grip at its end that faces the user.

The guide jaw and the guide rail can be separated from one another in a simple manner, for example by way of using snap mechanism.

In an embodiment, the putting-on aid moreover includes a guide motor, by way of which the guide jaw is movable along the at least one guide rail.

In embodiments of the putting-on aid having a guide motor as well as at least one motor that effects the movement of the carrier element or parts thereof for rolling off or rolling up the support stocking, in particular a drive motor, the force that is required for the rolling-off and rolling-up can be mustered solely by the drive motor or solely by the guide motor or by both. In embodiments, in which the guide motor significantly contributes to the rolling-off and rolling-up of the support stocking, the end of the guide rod, which is away from the user is preferably supported. The floor or a wall can serve for the supporting.

In embodiments that include a drive motor as well as a guide motor, the movements which are produced by the two motors are matched to one another. This is effected in particular by way of a corresponding activation of the motors themselves.

In an embodiment, the putting-on aid moreover fulfils the function of a rolling-up device that permits the rolling-up of the support stocking onto the carrier element or the rolling-off of this from the carrier element, without the support stocking being worn on a body part at any point on time of the rolling-up/rolling-off procedure. The term "rolling-up device" should consequently not be interpreted in a limiting manner. In particular, the rolling-up device can also be used for the controlled rolling-off of a support stocking, which is rolled up by the use of the putting-on aid. A support stocking, which is rolled up onto the carrier element, is necessary in order to put this on with the help of the putting-on aid. The rolling-off of a support stocking, which is rolled up onto the carrier element, can be necessary, for example, for hygienic reasons.

The rolling-up device can be realised by way of a suitable design of the guide jaw, the guide rail and the carrier element. For rolling up the support stocking, the opening of the support stocking, via which opening the body part is inserted into the support stocking on manually putting on the support stocking, merely needs to be led through the opening of the carrier element, in which opening the body part comes to lie on operation, and be hooked to the carrier element. The rolling-up of the support stocking can then take place by way of the activation of the carrier element and possibly of the rollers that are attached on the inner side of the guide jaw.

A support stocking, which is rolled up on the carrier element, can be rolled off by way of changing the rotation direction of the carrier element and possibly of the rollers that are attached on the inner side of the guide jaw.

Alternatively, the rolling-up device can also include another holder instead of guide jaws and a guide rail, wherein this other holder fixes the carrier element at a position in space, but herein does not inhibit the movement of the carrier element or parts thereof.

Alternatively or supplementarily, the rolling-up device can include a formation, onto which the support stocking can be wound without a large force effort. This formation can be a cylinder, for example. In this embodiment of the rolling-up device, the formation replaces the body part, by which mean the procedure for rolling up/rolling off the protective stocking onto and from the carrier element can be the same as when putting on and taking off a support stocking. This includes embodiments of the putting-on aid that make do without guide jaws and a guide rail.

In a further embodiment, the putting-on aid can moreover include a control. This control serves for the activation of the motors that are integrated in the putting-on aid, in particular of the guide motor for the translatory displacement of the guide jaw along the longitudinal axis of the rail, of the at least one adjusting motor for changing the opening, which is defined by the carrier element, and of the at least one drive motor, which ensures the revolving movement of the surface of the carrier element or parts thereof.

The control can be integrated into the hand grip of the guide rail. However, it can also be realised as an additional control unit. The control can communicate with the different motors of the putting-on aid by way of a cable or in a wireless manner, In embodiments, in which a cable is used for transmitting signals that are initiated by the user at the control, the cables run out exclusively on components of the second category, which is to say that the cable end that is at the carrier element side does not execute a rotational movement. Herein, the cable end that is at the carrier element side gets into the inside of the carrier element via recesses in the components of the first category of the carrier element. Herein, these recesses are continuous and are preferably designed perpendicularly to the longitudinal axis of the carrier element, so that the cable never snags and/or co-rotates with a component of the first category even given a complete revolution of these components.

Individual or all motors that are integrated into the putting-on aid can be electric motors.

The putting-on aid can be part of a kit that includes everything that is necessary for the operation and maintenance of the putting-on aid. In particular, the kit includes the putting-on aid itself, a battery, a charging device and a mains part. The battery can be fixedly integrated into the carrier element or into the guide rail, wherein the charging of the battery is effected via an opening in the jacket of the carrier element or via an opening in the guide rail.

In embodiments, in which the battery is integrated in the guide rail or in which the supply of the carrier element is effected via the mains part, the cabling, which is necessary for feeding the carrier element, is effected analogously to the previously described cabling for transmitting control signals, which is to say via continuous recesses in the components of the first category.

The present description mostly mentions orthopaedic stockings, but it is also to be understood that the putting-on aid can also be applied to different types of stockings.

BRIEF DESCRIPTION OF THE DRAWINGS

The subsequent drawings represent exemplary embodiments of the invention, by way of which the invention is described in more detail. In the drawings, the same reference numerals indicate the same or equally acting elements. The drawings show.

DETAILED DESCRIPTION OF THE INVENTION

The manner of functioning and the implementation of the invention are hereinafter shown by way of different exemplary embodiments. It is to be understood that the invention is not limited to these embodiments, but also includes other embodiments which are in conformity with the claims.

Figure 1:
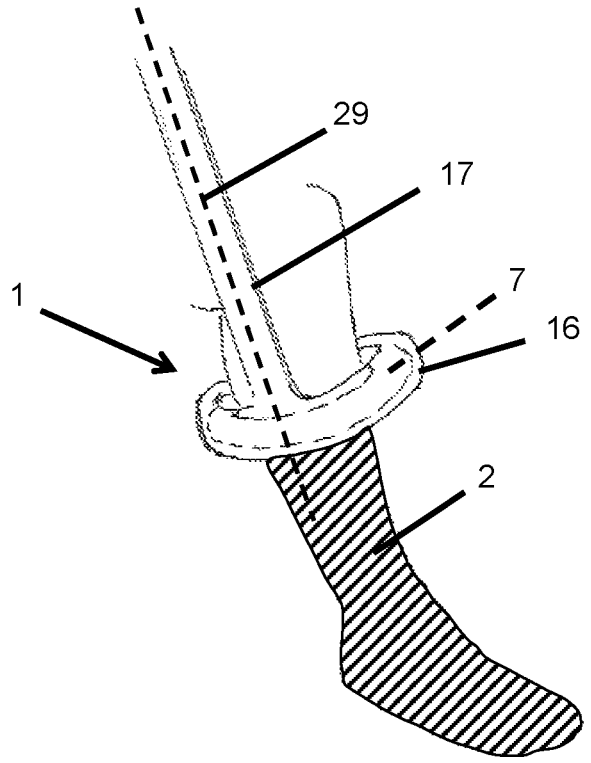
FIG. 1 is a schematic representation of an embodiment of a putting-on aid with a guide jaw and with a guide rail.

FIG. 1 shows a schematic representation of an embodiment of a putting-on aid 1 with a guide jaw 16 and with a guide rail 17, on operation. A support stocking 2 is already partly put onto a body part, here a leg. A carrier element 7 as well as the part of the support stocking 2 which is still rolled up on the carrier element 7 are covered by the guide jaw 16.

The guide jaw 16 is approximately perpendicular to a longitudinal axis 29 of the guide rail 17.

The guide jaw 16 on its inner side (not shown) includes snap mechanism which has the effect that the guide jaw 16 fixedly holds the carrier element 7. The snap mechanism includes elastic and resiliently mounted elements, so that its functional efficiency is ensured independently of the thickness of the rolled-up support stocking 2.

The guide rail 17 is manufactured of a strong, rigid material, for example of a metal or a metal alloy, in particular of aluminium, or of a plastic.

The guide jaw 16 is likewise manufactured essentially of a strong material, for example of one or more of the previously mentioned materials. However, the guide jaw 16 is elastic enough not to prevent the change of the dimensions of the carrier element 7, said change being effected by an adjusting mechanism 40 (see FIGS. 9-11). In particular, the guide jaw 16 can include elastic sections and/or openings and recesses which increases its elasticity along the axis which is relevant with a view upon the adjusting mechanism 40.

Figure 2:
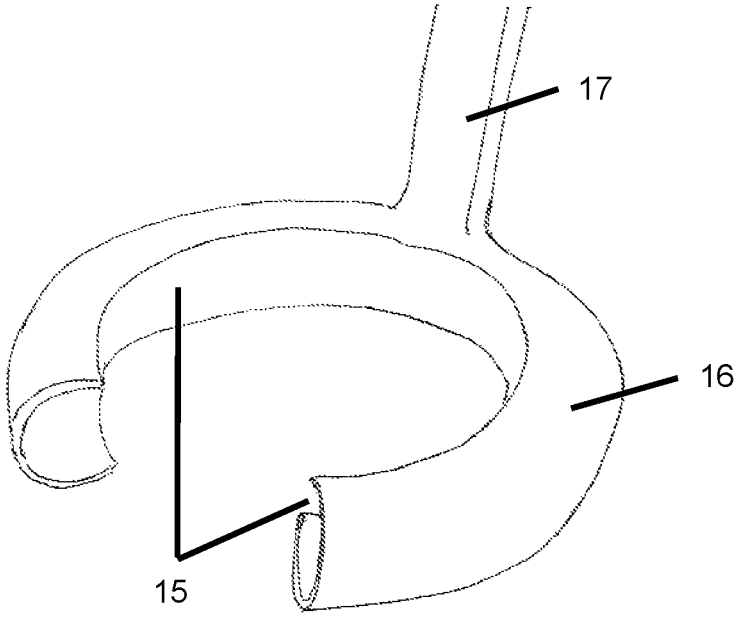
FIG. 2 is a schematic detailed view of the guide jaw and of the guide rail of the embodiment of the putting-on aid which is shown in FIG. 1.

FIG. 2 shows a schematic detailed view of the guide jaw 16 which is shown in FIG. 1 and of the guide rail 17 which is shown in FIG. 1. The guide jaw 16 is open at its inner side, which is to say the side which faces the body part on operation. The support stocking 2 can be transferred from the carrier element 7 onto the body part or onto another formation or from the body part/formation onto the carrier element 7 via this guide jaw opening 15.

Moreover, the guide jaw 16 is not closed in itself, but includes an opening at the side that is opposite to the guide rail, by which means the guide jaw 16 does not completely surround the body part on operation. This, in combination with an opening/closing mechanism of the carrier element 7 permits a simple removal of the guide jaw 16 and the carrier element 7 after the support stocking 2 has been completely rolled off.

Figure 3:
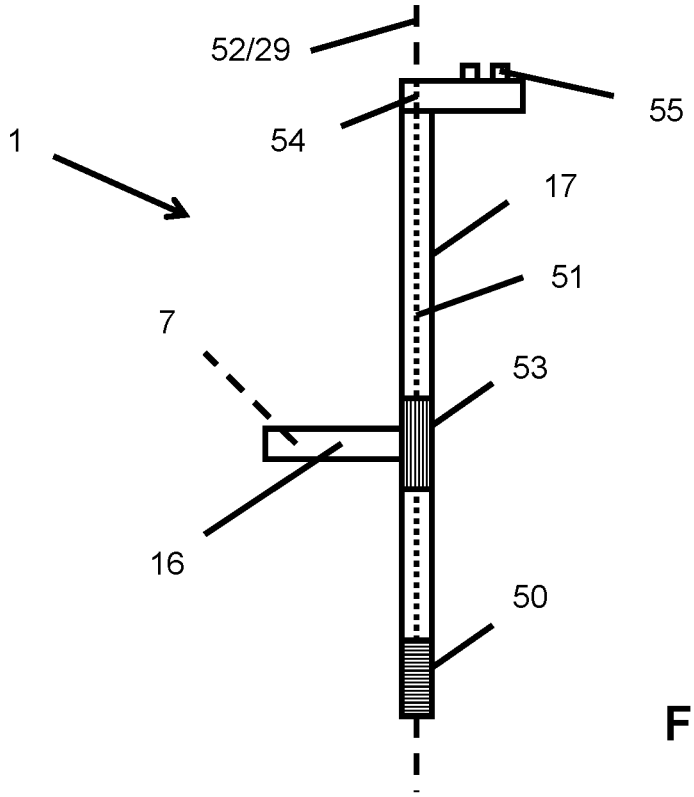
FIG. 3 is a schematic lateral view of an embodiment of the putting-on aid with guide jaw, guide rail and guide motor.

FIG. 3 shows a schematic lateral view of an embodiment of the putting-on aid 1, in which the guide jaw 16 can be additionally moved up and down along the guide rail 17. In the shown embodiment, the putting-on aid 1 moreover includes a guide motor 50, for example a stepper motor, a spindle 51 whose spatial alignment is given by the spindle longitudinal axis 52 and a carriage 53. The spindle 51 is integrated into the guide rail 17. Herein, the spindle longitudinal axis 52 runs parallel to the longitudinal axis 29 of the guide rail 17 and in particular it can coincide with this. As is known per se for positioning systems, the carriage 53 is movable along the spindle 51. The carriage 53 and the spindle 51 have threads which are matched to one another and which are designed such that the carriage 53 moves in a direction along the spindle longitudinal axis 52 given a clockwise rotation of the spindle 51, which is effected by the guide motor 50 and is moved along the spindle longitudinal axis 52 in the other direction given a rotation in the anti-clockwise direction.

The guide jaw 16 is fixedly connected to the carriage 53 and follows the movement of the carriage 53 along the spindle longitudinal axis 52. This, given a carrier element 7, which is received in the guide jaw 16, leads to a movement of the carrier element 7 along the longitudinal axis 29 of the guide rail 17.

The embodiment of the putting-on aid 1 according to FIG. 3 moreover includes a hand grip 54 that includes elements 55 for the control of individual ones or all of the motors, which are integrated into the putting-on aid 1.

Figure 4:
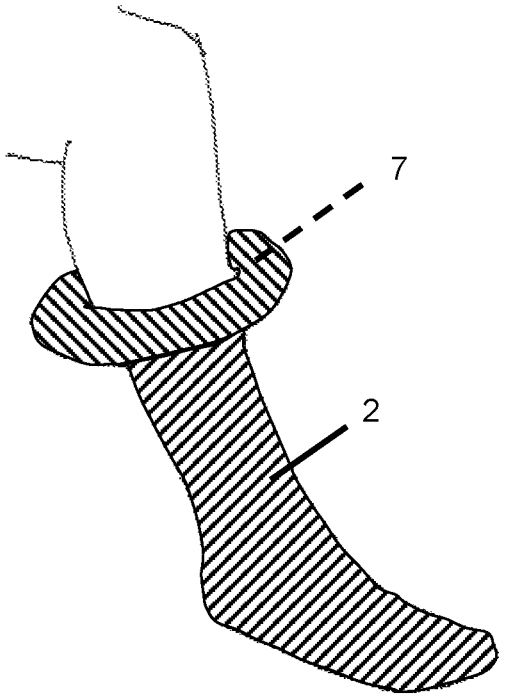
FIG. 4 is a schematic representation of an embodiment of the putting-on aid without a guide jaw and without a guide rail, on operation.

An embodiment of the putting-on aid 1 without a guide jaw 16 and guide rail 17 is shown on operation in FIG. 4. The carrier element 7 is covered by the part of the support stocking 2 which is not yet rolled off.

Figure 5:
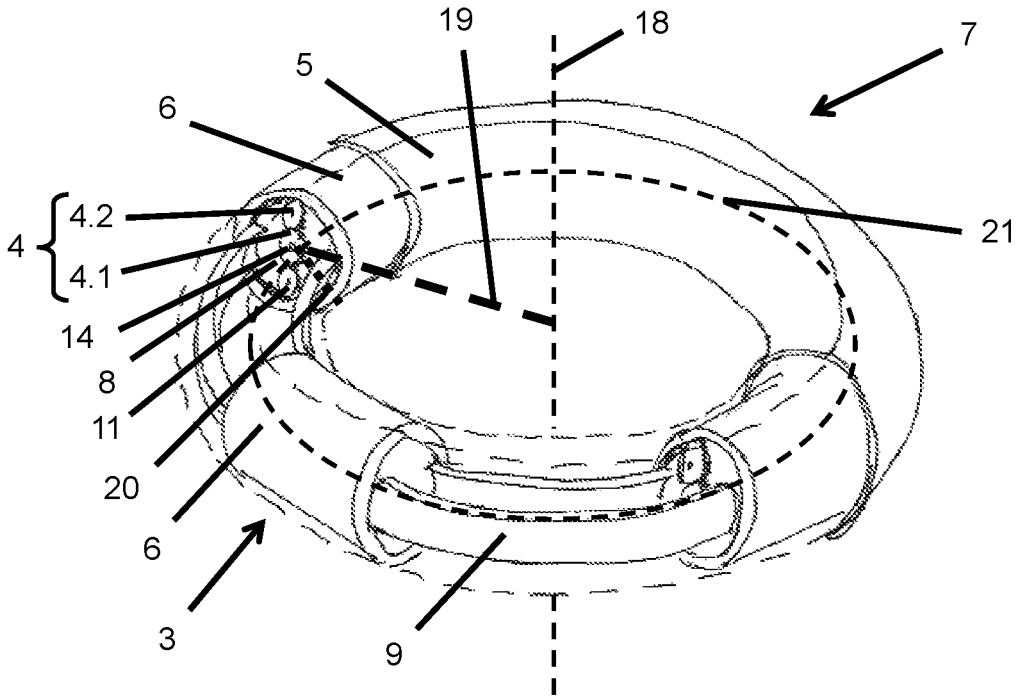
FIG. 5 is a sketch which shows the inner workings of an embodiment of a carrier element.

FIG. 5 shows the inner workings of the carrier element 7 as can be applied, for example, in the embodiments according to FIG. 1-4. In the represented embodiment of the carrier element 7, this has approximately the shape of a rotation torus, which is defined by a large radius 19, a small radius 20 as well as a circle line 21.

In the shown embodiment, an advance unit 5 forms the complete surface of the carrier element 7. On operation, the advance unit 5 is in direct contact with the support stocking 2. The advance unit 5 furthermore carries out a rotation about the circle line 21, which leads to a constant compression and stretching of the advance unit 5. For this reason, the advance unit 5 is manufactured from an elastic material, for example rubber or an elastic plastic.

The advance unit 5 itself is in direct contact with an advance connecting piece 6, which in the shown embodiment is designed as part of a drive unit 3.

Each drive unit 3 is designed cylindrically, wherein the advance connecting piece 6 forms the jacket of the cylinder.

The advance connecting piece 6 is driven via a planetary gear, including a sun wheel 4.1 and a planet wheel 4.2. In the shown embodiment, the advance connecting piece 6 in part-regions includes an inner-side toothing (see also FIGS. 6-8 for detailed representations). The advance connecting piece 6 is driven by two, three or more planet wheels 4.2 via this toothing.

The sun wheel 4.1 itself is connected via a drive shaft 14 to a drive motor 13, which is spatially delimited by a motor housing 13.1, and can be brought into rotation by this.

The rotating parts—the advance connecting piece 6, the planetary gear 4 and the drive shaft 14 are carried by non-rotating parts via a mounting 11, which does not prevent the rotational movement of these parts. Amongst other things, a fixation bock 8, one or more connecting elements 9 as well as a motor hosing 13.1 belong to the non-rotating parts.

The connecting elements 9 are anchored in the fixation block 8. It is these non-rotating parts that give the carrier element 7 the necessary stability by way of these being torsionally stable and pressure-resistant.

Figure 6:
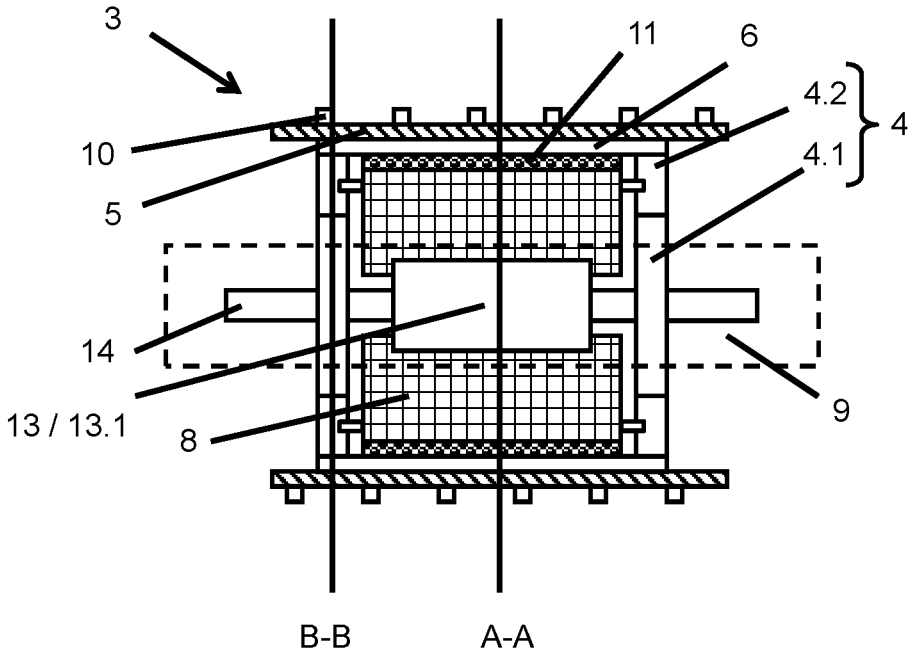
FIG. 6 is a schematic representation of a longitudinal section through an embodiment of a drive unit.

By way of a middle longitudinal section through the drive unit 2, which is designed in a cylinder-shaped manner, FIG. 6 illustrates the construction of this, as can be applied in a carrier element 7 according to FIG. 5. The arrangement of the moving parts—the drive shaft 14, the planetary gear 4 that includes a sun wheel 4.2 and a planet wheel 4.2, as well as the advance connecting piece 6 is shown. The arrangement of the non-moving parts—the motor housing 13.1, the fixation block 8 and the connecting element 9, which in the shown embodiment is located in a plane in front of and/or behind the section plane, is also represented. A mounting 11 confers the mechanically stability of the non-moving parts upon the moving parts 7 without inhibiting these in their rotational movement.

The drive of the advance connecting piece 6 is effected in the region of the planet wheel 4.2. In this region, the advance connecting piece 6 is toothed at the inner side. The sun wheel 4.1, the planet wheel 4.2 and the advance connecting piece 6 are designed as a planetary gear with a stationary gear ratio in the embodiment that is shown in FIG. 6.

In the embodiment that is shown in FIG. 6, the advance unit 5 is in extensive (surfaced), rotationally fixed contact with the advance connecting piece 6. However, one can also make do without the advance connecting piece 6 by way of a suitable design of the inner side of the advance unit 5.

Moreover, naps 10 or other elements such as hooks or clips or a non-slip coating are attached to the advance element 5 and these encourage a meshing of the support stocking 2 with the advance unit 5 and thus prevent the slipping of the support stocking 2 and an empty-rotating of the carrier element 7.

Figure 7:
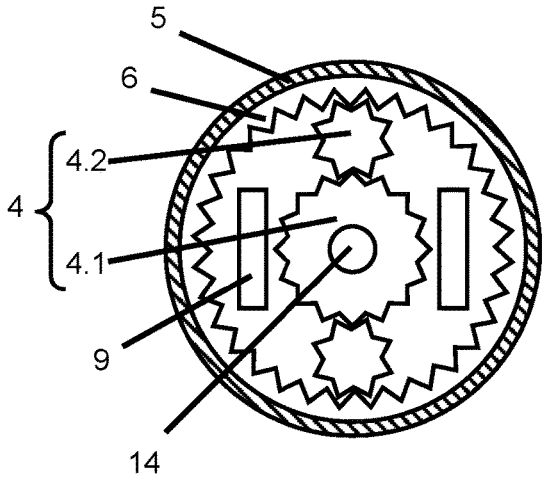
FIG. 7 is a schematic representation of a cross section through the embodiment of the drive unit which is shown in FIG. 6, along the axis B-B.
Figure 8:
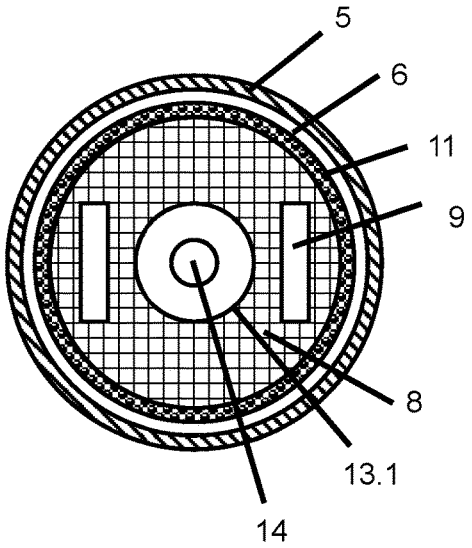
FIG. 8 is a schematic representation of a cross section through the embodiment of the drive unit which is shown in FIG. 6, along the axis A-A.

FIGS. 7 and 8 show sections along the planes that are indicated in FIG. 6. By way of a section along B-B, FIG. 7 in a more detailed manner shows how the rotation of the drive shaft 14, which is effected by the drive motor 13, is transmitted via the planetary gear 4 onto the advance connecting piece 6 and the advance unit 5. Likewise represented are the connecting elements 9, which pass through the section plane. The fixation block 8 itself has no region that is located in the section plane.

Likewise in a detailed manner, FIG. 8 by way of a section along A-A shows how the rotating parts—the advance connecting piece 6 and the advance unit 5—via the bearing 11 are carried by the non-rotating parts—the motor housing 13.1, the fixation block 8 and the connecting element 9.

Figure 9:
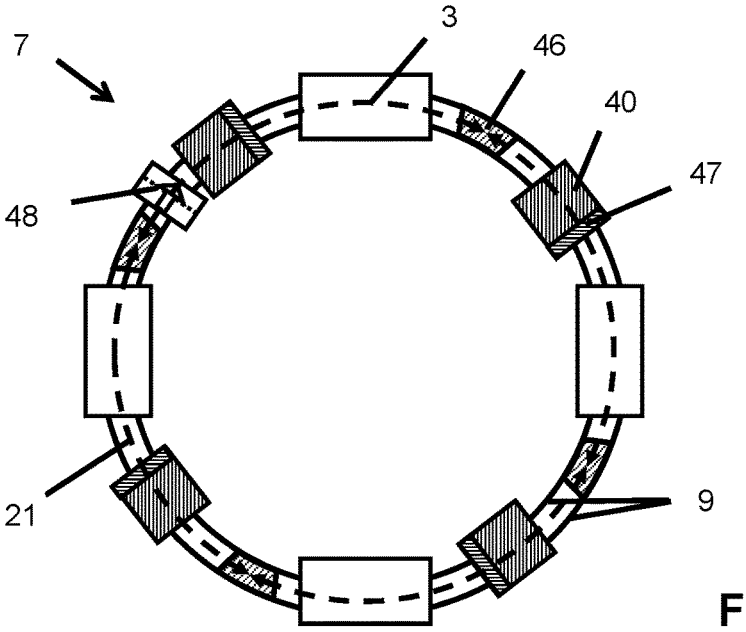
FIG. 9 is a further schematic representation of the inner workings of an embodiment of the carrier element.

FIG. 9 schematically shows the inner workings of an embodiment of the carrier element 7. In this embodiment, apart from drive units 3 and connecting elements 9, the carrier element 7 includes an elastic element 46, an adjusting mechanism 40, a sensor 47 and an opening/closing mechanism 48.

The elastic element 46 ensures a tension along the longitudinal axis of the carrier element 7. A carrier element 7 in the form of a rotation torus is shown, wherein the mentioned longitudinal axis of the carrier element 7 is identical to the circle line 21 of the rotation torus. This tension leads to a clamping effect upon the body part, which on operation is surrounded by the carrier element 7, the effect finally permitting the upwards and downwards moving of the carrier element 7 along the body part.

The sensor 47 measures the tensile force that occurs along the longitudinal axis 21 of the carrier element 7 and gives a signal to the adjusting mechanism 40 as soon as a previously defined minimal value is fallen short of or a previously defined maximal value is exceeded. In the first case, a contraction of the adjusting mechanism 40 along the longitudinal axis 21 of the carrier element 7 is initiated by the signal. In the second case, accordingly an expansion of the adjusting mechanism 40 along the longitudinal axis 21 of the carrier element 7 is initiated.

The opening/closing mechanism 48 ensures that the carrier element 7 can be opened, in order, for example, to simply remove the carrier element 7 from the body part after the support stocking 2 has been put on or in order to position the carrier element on the body part before taking off the support stocking 2.

Figure 10:
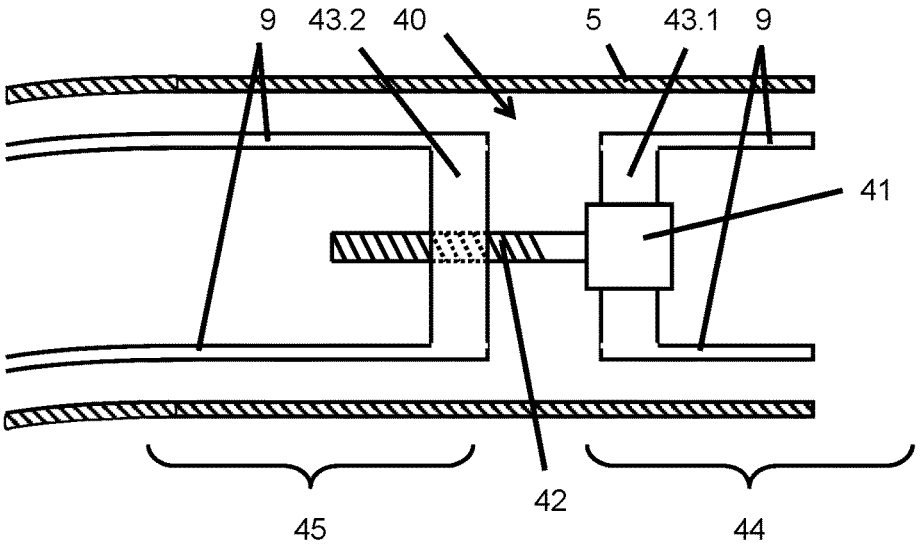
FIG. 10 is a schematic representation of an embodiment of an adjusting mechanism which enlarges or reduces the dimension of the opening which is defined by the carrier element.

A schematic representation of an embodiment of an adjusting mechanism 40 is shown in FIG. 10 and this serves for enlarging or reducing the area that is at least partly encompassed by the carrier element 7 on operation. Concerning FIG. 5, it is the case of a section that is perpendicular to the rotation axis 18 and that contains the longitudinal axis of the carrier element 7 or the circle line 21 of the rotation torus.

Regarding the shown adjusting mechanism 40, it is the connecting elements 9 that change their length parallel to the longitudinal axis of the carrier element 7. The adjusting mechanism 40 is arranged between two connecting elements 9 that are straight in the region of the adjusting mechanism 40 and that run in parallel. For this, the two connecting elements 9 are interrupted perpendicularly to the longitudinal axis, by which means a first part-connecting-region 44 and a second part-connecting-region 45 arise. In the shown embodiment, these part-connecting-regions correspond to the previously introduced part-elements of the adjusting mechanism. The termination or closure of these two part-connecting-regions 44/45 is formed by a first fixed connecting piece 43.1 and a second fixed connecting piece 43.2

The first connecting piece 43.1, which is arranged in the first part-connecting-region 44, carries an adjusting motor 41 and an adjusting gear 42, which at least partly includes a thread.

The connecting piece 43.2, which is arranged in the second part-connecting-region 45, includes a bore with a thread, the thread being matched to the thread of the adjusting gear 42.

The adjusting gear 42 can now be rotated via the adjusting motor 41, by which means the distance between the two part-connecting-regions 44/45 and thus the distance between the two fixation blocks, in which the connecting elements 9 participating in the adjusting mechanism 40 are anchored on their side that is away from the adjusting mechanism, can be changed.

The shown adjusting mechanism 40 can be an element that is autonomous within the carrier element 7, as well as a constituent of a drive unit 3.

Figure 11:
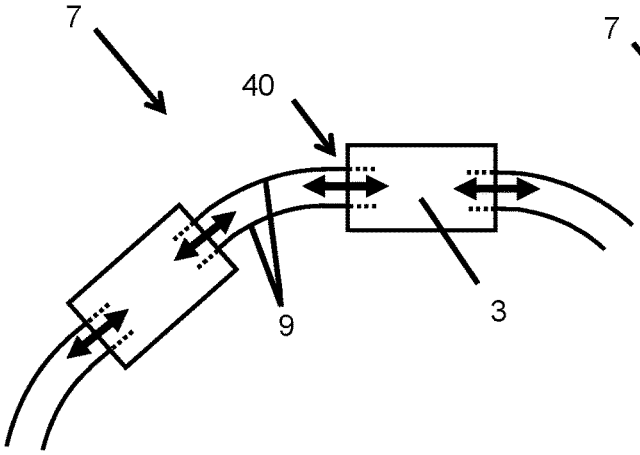
FIG. 11 is a schematic representation of an embodiment of the carrier element with the adjusting mechanism.
Figure 12:
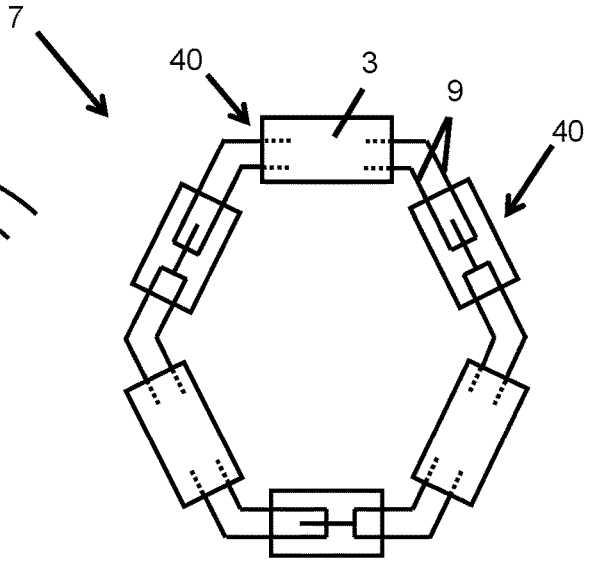
FIG. 12 is a schematic representation of the inner workings of an embodiment of the carrier element with the adjusting mechanism.

FIGS. 11 and 12 show two embodiments of carrier elements 7 which include an adjusting mechanism 40. In FIG. 11, the adjusting mechanism 40 is integrated into the drive unit 3. The region of the carrier element 7 in which the carrier element 7 has no bending is increased or reduced by way of actuating the adjusting mechanism 40. Given a suitable arrangement of the drive units 3 and bent connecting elements 9, a carrier element 7 that is capable of at least partly encompassing a body part is realised, wherein the sectional area that can be at least partly encompassed can be adjusted via the adjusting mechanism 40.

FIG. 12 schematically shows the inner workings of a carrier element 7 that is capable of completely enclosing a body part. For this, the drive units 3 and units of the adjusting mechanism 40 are arranged on the sides of an n-polygon in an alternating manner. A hexagon is shown in the figure for the sake of simplicity, even if other geometric shapes with a larger number of corners and/or rounded corners are capable of better reproducing the cross-sectional shape.

In the shown embodiment of the carrier element 7, the drive units 3 themselves also have an adjusting mechanism 40. The shape of the carrier element 7 can be set to a finer degree by way of this.

Figure 13:
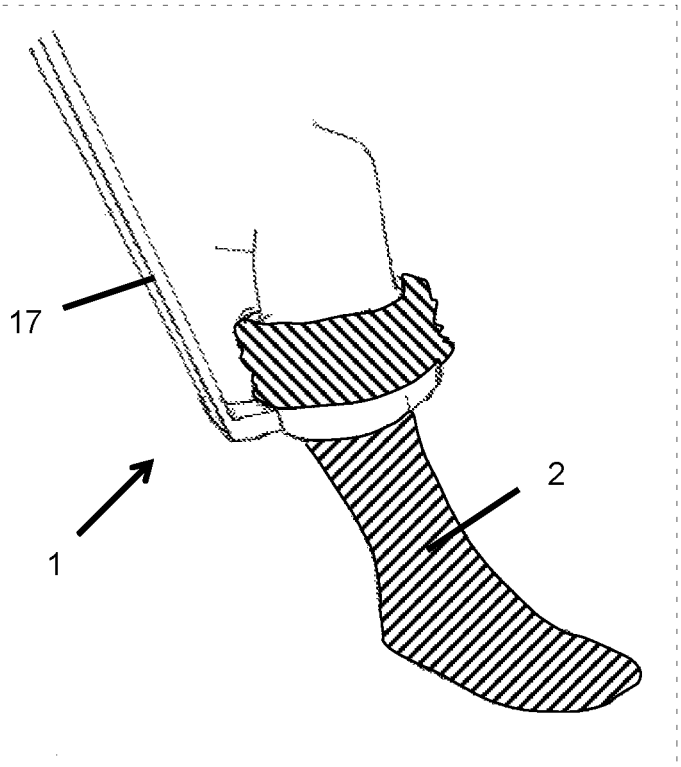
FIG. 13 is a schematic representation of an alternative embodiment of the putting-on aid with a guide rail, on operation.

An alternative embodiment of a putting-on aid 1 with a guide rail 17 is shown on operation in FIG. 13, wherein this embodiment is likewise in concordance with the invention. What is show is a condition, in which the support stocking 2 is only partly put onto the body part, here the leg. In this embodiment, before being rolled off, the support stocking 2 is not rolled up on the carrier element 7, which is covered by the support stocking 2, but it is merely stretched out by the carrier element 7.

Figure 14:
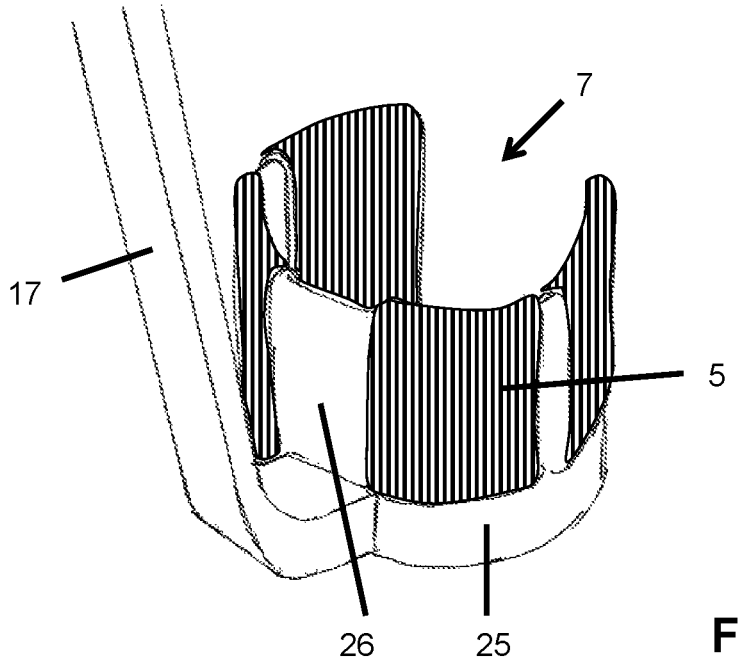
FIG. 14 is a schematic detailed view of the embodiment of the putting-on aid which is shown in FIG. 13.

FIG. 14 is a schematic detailed representation of the putting-on aid 1 according to FIG. 13. In this embodiment, the surface of the carrier element 7 includes part-regions that execute a revolving movement, as well as part regions that execute no orbital movement. The later includes a foot 25 as well as a continuation 26, wherein the continuation 26 extends along that axis, along which the putting-on aid 1 moves on rolling off and rolling up the support stocking 2.

The non-revolving part-regions permit the connection of the carrier element 7 to the guide rail 17 without the use of a guide jaw. These regions moreover create space, in order to accommodate components of the putting-on aid 1, such as driving motors, gears, advance connecting pieces and holding and/or supporting elements, in a simply accessible manner. The drive units are accommodated in the foot 25 in the shown embodiment.

The revolving part-regions include an advance unit 5, which is designed in the form of runner bands that run around part-regions of the continuation 26.

In this alternative embodiment, an advance unit 5 is externally driven, which means from a region that the drive unit 5, which is closed in itself, does not encompass. This is effected by the of the advance unit 5 including regions, in which hooks or teeth or guide pins that are attached on the advance connecting piece 6 (covered by the housing of the foot 25 and the advance unit 5 in FIG. 14) can latch in. The rotational movement of the advance connecting piece 6, which is driven by a motor is thus transmitted onto the advance unit 5.

In a manner that is analogous to the previous embodiments, in particular to the embodiments that are shown in FIGS. 5-9, the advance unit 5 can alternatively be driven from the inside, i.e. from a region around which the advance unit 5 runs.

The invention claimed is:

1. A putting-on aid for support stockings, comprising a carrier element, wherein the carrier element is capable of at least partly encompassing a body part, and wherein the carrier element comprises at least one motor which is designed to bring the carrier element or parts thereof into motion, wherein the motion is capable of at least assisting a rolling-off and rolling-up of a support stocking by the motion being a revolving movement and by the carrier element being configured to at least partly encompass the body part in a manner that the revolving movement permits or assists a translational motion of the carrier element along an axis of the body part.

2. The putting-on aid according to claim 1, wherein the at least one motor produces a force which is sufficient for the rolling-off and rolling-up of the support stocking.

3. The putting-on aid according to claim 1, wherein the carrier element is configured to at least partly encompass the body part to advance along this body part, during the rolling-off and rolling-up of the support stocking, wherein this advancing is of a nature such that a putting-on and taking-off of the support stocking takes place in combination with the rolling-off and rolling-up respectively of this support stocking.

4. The putting-on aid according to claim 1, wherein the carrier element approximately has the shape of a torus.

5. The putting-on aid according to claim 4, wherein the carrier element approximately has the shape of a rotation torus.

6. The putting-on aid according to claim 1, wherein the carrier element comprises at least one drive unit and at least one advance unit, wherein each of the at least one advance units is configured to execute a revolving movement and to be driven by at least one drive unit, and wherein the at least one advance unit forms the surface of the carrier element or parts of a surface of the carrier element.

7. The putting-on aid according to claim 6, wherein the revolving movement of the carrier element or parts thereof includes the revolving movement of the at least one advance unit.

8. The putting-on aid according to claim 6, wherein the at least one motor is a drive motor comprising a motor housing and a drive shaft, wherein the drive motor is configured to drive the at least one drive unit via the drive shaft.

9. The putting-on aid according to claim 8, wherein each of the at least one drive units comprises the drive motor and the drive shaft, and wherein the drive unit comprises at least one component of a first category and at least one component of a second category, wherein a component of the first category is configured to co-rotate with the drive shaft and to be driven by said drive shaft and wherein a component of a second category assumes a fixed position relative to the motor housing.

10. The putting-on aid according to claim 9, wherein the drive unit comprises a planetary gear which is driven by the drive motor, and an advance connecting piece as components of the first category, wherein the planetary gear is configured to drive the advance connecting piece which for its part is configured to drive the advance unit, and wherein the drive unit moreover comprises a bearing and a fixation block as components of the second category, wherein the fixation block connects the components of the second category, and the bearing permits a rotation movement of the components of the first category about the fixation block.

11. The putting-on aid according to claim 6, wherein the putting-on aid comprises at least two drive units and at least one connecting element which connects the drive units to one another in a torsionally stable manner.

12. The putting-on aid according to claim 1, comprising an adjusting mechanism which is designed to change the length of an axis of the carrier element, wherein the length of the axis fixes the area which the carrier element is capable of at least partly surrounding on operation.

13. The putting-on aid according to claim 12, wherein the adjusting mechanism comprises an adjusting gear, an adjusting motor and two part-elements, wherein the two part-elements overlap in a region along the mentioned axis of the carrier element, wherein the length of this overlapping region can be changed by the adjusting gear and wherein the adjusting gear can be driven by the adjusting motor.

14. The putting-on aid according to claim 13, wherein the adjusting motor can be activated in at least one of the following manners: automatically by a sensor, manually by the user.

15. The putting-on aid according to claim 1, comprising a guide jaw and at least one guide rail which is connected to the guide jaw, wherein the guide jaw is designed to fixedly hold the carrier element without the movement of the carrier element or parts thereof being inhibited.

16. The putting-on aid according to claim 15, comprising a guide motor which is capable of moving the guide jaw along the at least one guide rail.

17. The putting-on aid according to claim 15, wherein the guide jaw, the at least one guide rail and the carrier element are designed to permit the rolling-up of a support stocking, which is not put on, onto the carrier element or the rolling-off of this from the carrier element, wherein the rolling-off does not lead to a putting-on of the support stocking.

18. The putting-on aid according to claim 1, wherein the putting-on aid comprises a control, wherein the control serves for the control of all motors which are integrated into the putting-on aid.

19. A kit for putting on a support stocking, comprising a putting-on aid according to claim 1, a charging device, a battery and a mains part.

* * * * *